US005735352A

United States Patent [19]

Henderson et al.

[11] Patent Number: 5,735,352

[45] Date of Patent: Apr. 7, 1998

[54] METHOD FOR UPDATING A SITE DATABASE USING A TRIANGULAR IRREGULAR NETWORK

[75] Inventors: Daniel E. Henderson, Washington; Craig L. Koehrsen, Peoria; David A. Paul, Peoria; William C. Sahm, Peoria, all of Ill.

[73] Assignee: Caterpillar Inc., Peoria, Ill.

[21] Appl. No.: 768,150

[22] Filed: Dec. 17, 1996

[51] Int. Cl.[6] ..... G05B 19/18; F21B 21/06

[52] U.S. Cl. ..... 172/4.5; 37/348; 364/167.01; 364/424.07

[58] Field of Search ..... 37/348; 172/4, 172/4.5, 7, 9, 789, 793; 364/167.01, 424.07, 559

[56] References Cited

U.S. PATENT DOCUMENTS

| | | | |
|---|---|---|---|
| 5,078,215 | 1/1992 | Nau | 172/4.5 |
| 5,100,229 | 3/1992 | Lundberg et al. | 172/4.5 X |
| 5,404,661 | 4/1995 | Sahm et al. | 37/348 |
| 5,607,205 | 3/1997 | Burdick et al. | 299/1.5 |
| 5,612,864 | 3/1997 | Henderson | 364/167.01 |
| 5,631,658 | 5/1997 | Gudat et al. | 364/424.07 X |

OTHER PUBLICATIONS

SPI (Software Patent Institute Database of Software Technologies) Record 10, Title: Genacivil, dated Feb. 1, 1995, S/N HPAPPS.1576.

SPI (Software Patent Institute Database of Software Technologies) Record 11, Title: GeoTIN, dated Feb. 1, 1995, S/N HPAPPS.1584.

SPI (Software Patent Institute Database of Software Technologies) Record 9—Title: Star Topo dated Feb. 1, 1995, S/N HPAPPS.0764.

SPI (Software Patent Institute Database of Software Technologies) Record Display—Title: ARC/Info TIN dated Feb. 1, 1995, S/N HPAPPS.1563.

*Primary Examiner*—Terry Lee Melius
*Assistant Examiner*—Robert Pezzuto
*Attorney, Agent, or Firm*—James R. Yee

[57] ABSTRACT

The present invention provides a method for updating a site database. The site database models the elevation of a work site using a Triangular Irregular Network (TIN). The TIN is composed of a plurality of points. Each point has associated known X and Y coordinates and a known elevation and is associated with a set of other points in the network to form triangles. The work site is modified by a work machine. The method includes the steps of receiving a new set of points. The new set of points includes at least first and second points. The first and second points have associated X, Y, and Z coordinates. The method also includes the steps of comparing the new set of points with a previous set of points and updating the triangular irregular network with the new set of points if a minimum distance has been traversed by the work machine.

6 Claims, 7 Drawing Sheets

METHOD FOR UPDATING A SITE DATABASE USING A TRIANGULAR IRREGULAR NETWORK

TECHNICAL FIELD

This invention relates generally to a site database structure and, more particularly, to a method for updating a site database having a database structure represented in a triangular irregular network.

BACKGROUND ART

Work machines such as mining shovels and the like are used for excavation work. Much effort has been aimed at automating the work cycle or portions of the work cycle of such machines.

One such system is disclosed in U.S. Pat. No. 5,404,661 issued to William C. Sahm et al on Apr. 11, 1995. The Sahm system, aimed at a mining shovel, determines the position of a bucket of a work implement as it excavates, i.e., modifies the work site. The position of the bucket as it modifies the work site is used to update a site model or database. The current site model is compared with a desired site model by a differencing algorithm. The output of the differencing algorithm is used to control operation of the work machine or is displayed to the operator to assist in operation.

The work site covers a generally large area. Thus, the database is typically large as well, requiring a resultant large amount of storage space.

In one approach, a Triangular Irregular Network, or TIN, is used. The TIN is composed of a plurality of points having X and Y coordinates. For each point in the network, the database stores elevation information and the other points to which it is connected. The TIN is used to give a better approximation or representation of the work site. One factor which allows the TIN to be more accurate is that the points composing the network are not regular. The positions of the points are dictated by the surface of the work site. The TIN has previously been used to model and/or display site surfaces statically, i.e., based on static data. However, in order to utilize the TIN in a realtime environment, the TIN must be updated in realtime.

The present invention is directed at overcoming one or more of the problems as set forth above.

DISCLOSURE OF THE INVENTION

In one aspect of the present invention, a method for updating a site database is provided. The site database models the elevation of a work site using a Triangular irregular Network (TIN). The network is composed of a plurality of points. Each point has associated known X and Y coordinates and a known elevation and is associated with a set of other points in the network to form triangles. The work site is modified by a work machine. The method includes the steps of receiving a new set of points. The new set of points includes at least first and second points, the first and second points having associated X, Y, and Z coordinates. The method also includes the steps of comparing the new set of points with a previous set of points and updating the triangular irregular network with the new set of points if a minimum distance has been traversed by the work machine.

BEST MODE FOR CARRYING OUT THE INVENTION

Figure 1:
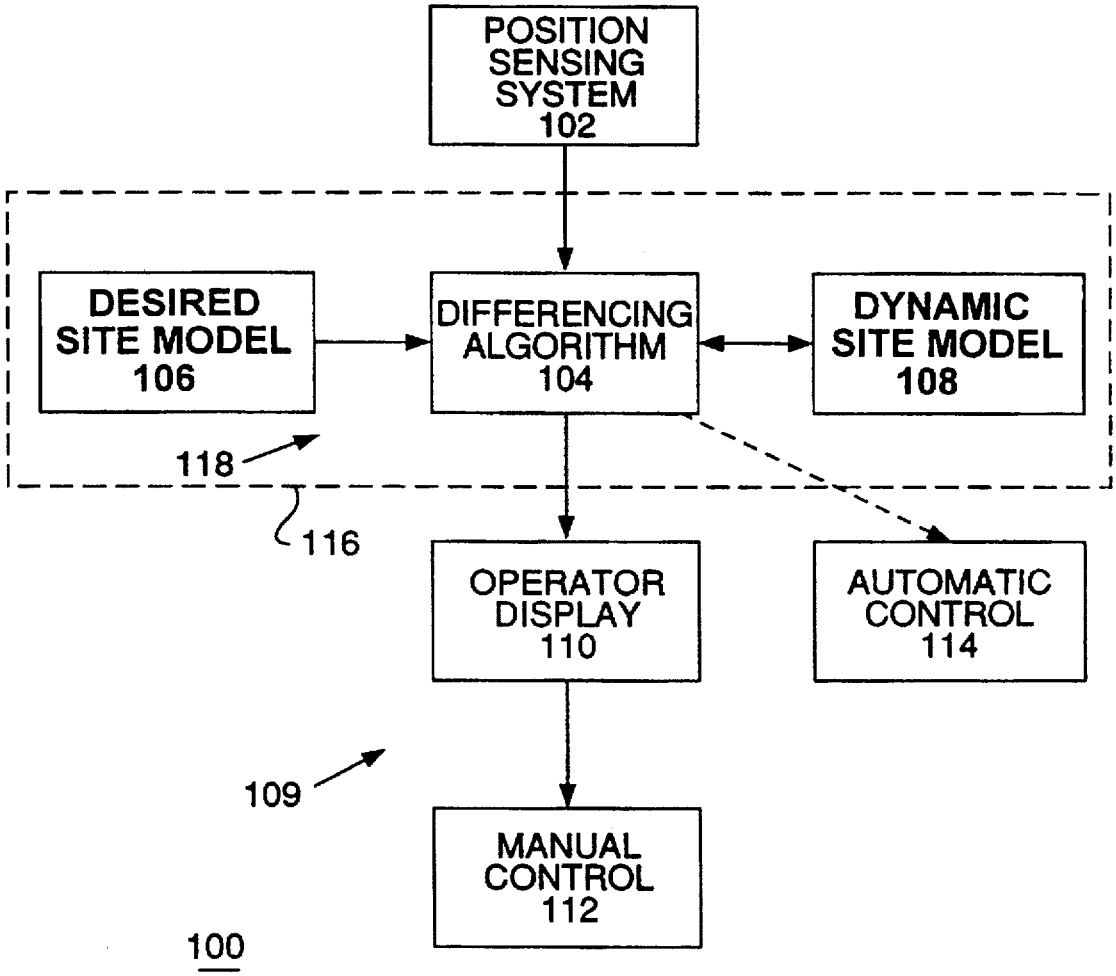
FIG. 1 is a block diagram of an apparatus for implementing the present invention, according to one embodiment.

With reference to FIGS. 1–9, the present invention provides a method for updating a site database 204. The site database 204 represents a work site 202.

In the preferred embodiment, the present invention is used in conjunction with a mobile earthmoving or work machine (not shown) such as a track-type tractor or dozer, a profiler, a motorgrader, a scraper, a road reclaimer, a wheel loader and the like.

A position sensing system 102 determines the position of a point located on the mobile machine. The point may be located on the body of the machine or on a work implement (not shown) of the mobile machine. As discussed below, the position of at least two reference points located on the machine are used to dynamically update the site database 204.

In the preferred embodiment, the mobile machine is a motor grader having a work blade. The position sensing system 102 is used to determine the position of three points on the work blade, the left blade tip, the right blade tip and the blade midpoint.

In the preferred embodiment, the position sensing system 102 includes a three-dimensional positioning system with an external reference, for example, (but not limited to) 3-D laser, Global Positioning Systems (GPS), GPS/laser combinations, radio triangulation, microwave, or radar. Position coordinates of the reference point are determined as the mobile machine operates within the work site 202.

A micro-processor based controller 116 is coupled to the position sensing system 102. The controller 116 receives the position coordinates from the position sensing system 102 and updates a dynamic site model 108. The controller 116 may also perform other functions as described below.

The position coordinates are supplied as a series of discrete points to a differencing algorithm 104.

The controller 116 includes a storage memory 118 for storing a desired site model 106 and the dynamic site model 108. The desired site model 106 and the dynamic site model 108 each includes a site database 204. Preferably, the desired site and the dynamic site databases 204 store data representing site elevations (desired elevation and current elevation, respectively). However, the site databases 204 may additionally store values of other parameters of the work site 202, e.g., material or ore type, previous elevation, number of passes by the work machine.

The differencing algorithm 104 is implemented in software on the controller 116 and calculates the difference between the desired site model 106 and the dynamic site model 108.

The differencing algorithm 104 is coupled to a directing means 109. The directing means 109 accesses the site databases 204 and responsively directs operation of the working machine. The directing means 109 preferably includes an operator display 110. The operator display 110 includes a graphical representation of the work site 202 illustrating the stored values of the parameter(s). The operator display 110 is used to assist the operator in manual control 112 of the work machine. Optionally, the directing means 109 may include an automatic control 114 for autonomously controlling operation of the work machine in response to the data stored in the site databases 204.

The desired site model 106 and the dynamic site model 108 are preferably stored in the memory 118. The memory 118 may be any suitable memory structure for storing data including, but not limited to, random access memory, programmable read only memory, fixed disk drives, removable disk drives, and the like.

The memory 118 stores data for access by an application program being executed on the controller 116. The memory 118 stores data in a data structure. The data structure includes information resident in the databases used by the application program.

Figure 2:
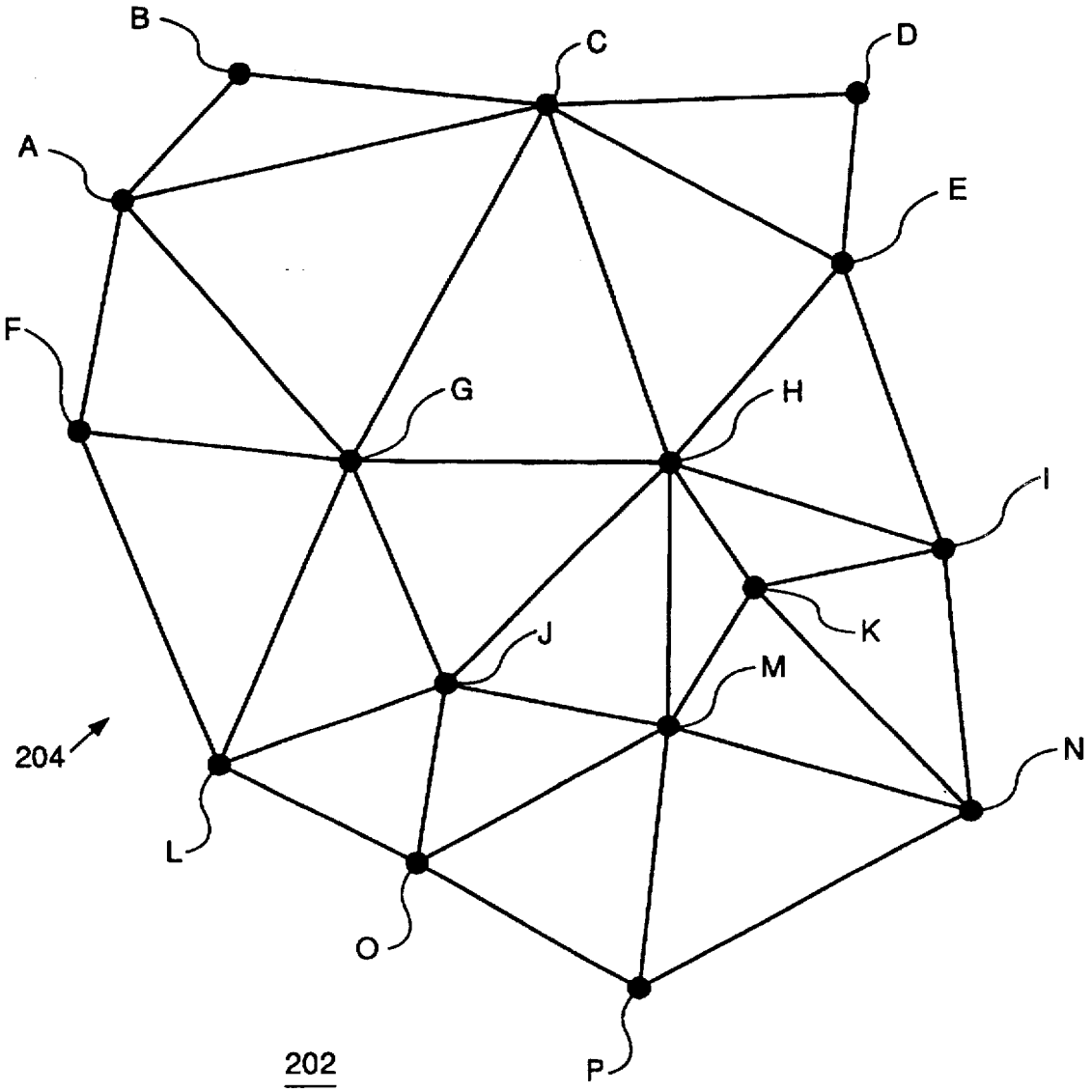
FIGS. 2 is a diagrammatic representation of a database structure using a Triangular Irregular Network (TIN) for representing and storing parameter values associated with a work site.

With reference to FIG. 2, elevation information is stored in the site database 204 using a data structure called a Triangular Irregular Network or TIN. The TIN is composed of a plurality of points (Points A–P). Each point has associated known X and Y coordinates and a known elevation value. The site database 204 also includes, for each point, a list of the other points with which the point is linked to form triangles. For the sample network shown in FIG. 2, the data stored in the site database 204 is listed in Table One.

TABLE ONE

| Point | X, Y | Elevation | Associated Points |
|---|---|---|---|
| A | $X_A$, $Y_A$ | $E_A$ | B, C, F, G |
| B | $X_B$, $Y_B$ | $E_B$ | A, C |
| C | $X_C$, $Y_C$ | $E_C$ | A, B, D, E, H, G |
| D | $X_D$, $Y_D$ | $E_D$ | C, E |
| E | $X_E$, $Y_E$ | $E_E$ | C, D, H, I |
| F | $X_F$, $Y_F$ | $E_F$ | A, G, L |
| G | $X_G$, $Y_G$ | $E_G$ | A, C, F, H, J, L |
| H | $X_H$, $Y_H$ | $E_H$ | C, E, G, I, J, K, M |
| I | $X_I$, $Y_I$ | $E_I$ | E, H, K, N |
| J | $X_J$, $Y_J$ | $E_J$ | G, H, L, M, O |
| K | $X_K$, $Y_K$ | $E_K$ | H, I, M, N |
| L | $X_L$, $Y_L$ | $E_L$ | F, G, J, O |
| M | $X_M$, $Y_M$ | $E_M$ | H, J, K, N, O, P |
| N | $X_N$, $Y_N$ | $E_N$ | I, K, M, P |
| O | $X_O$, $Y_O$ | $E_O$ | J, L, M, P |
| P | $X_P$, $Y_P$ | $E_P$ | M, N, O |

Additionally, for each point, the angle between each line segment formed by the point and the other points and a predefined vector, e.g., a horizontal vector, are stored. For example, for point A there are four angles stored: $ANGLE_{AB}$, $ANGLE_{AC}$, $ANGLE_{AG}$, and $ANGLE_{AF}$ (the angles defined by the horizontal axis and lines segments AB, AC, AG, and AF, respectively).

Figure 3:
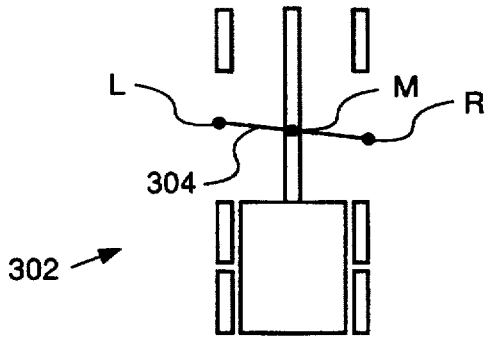
FIG. 3 is a diagrammatic top view of a work machine, shown as a motor grader.

The present invention provides a method for updating the Triangular Irregular Network based on new datapoints received from the position sensing system 102. With reference to FIG. 3, the mobile machine is preferably a motor grader 302. The motor grader 302 includes a work blade 304. The position sensing system 102 is adapted to determine the position in site coordinates of the left blade tip (L), the right blade tip (R), and the blade midpoint (M).

Figure 4:
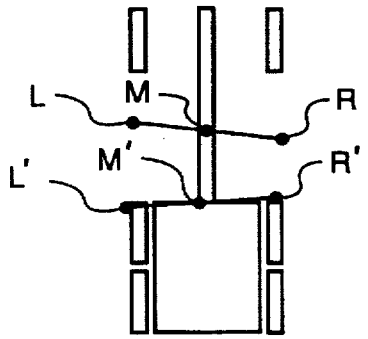
FIG. 4 is a diagrammatic top view of the motor grader of FIG. 3 having a current position and a previous position.

With reference to FIG. 4, as the mobile machine 302 traverses the work site 202, previous blade positions (L', M', R') are stored and the new, current positions are determined (L, M, R).

Figure 5:
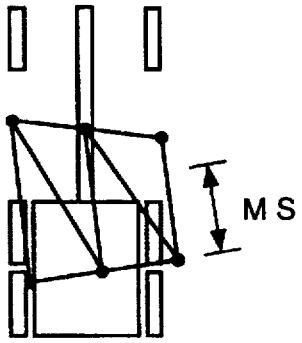
FIG. 5 is a diagrammatic top view of the motor grader of FIG. 3 having a current position and a previous position, illustrating new datapoints to be included in a site database.

With reference to FIG. 5, datapoints are not stored unless the minimum distance between any point and the previous corresponding point, e.g., L and L', is greater than a predetermined minimum spacing (MS). This ensures that the database does not become too large while ensuring the desired resolution. In the preferred embodiment, the minimum spacing is equal to approximately half the blade width.

Figure 6:
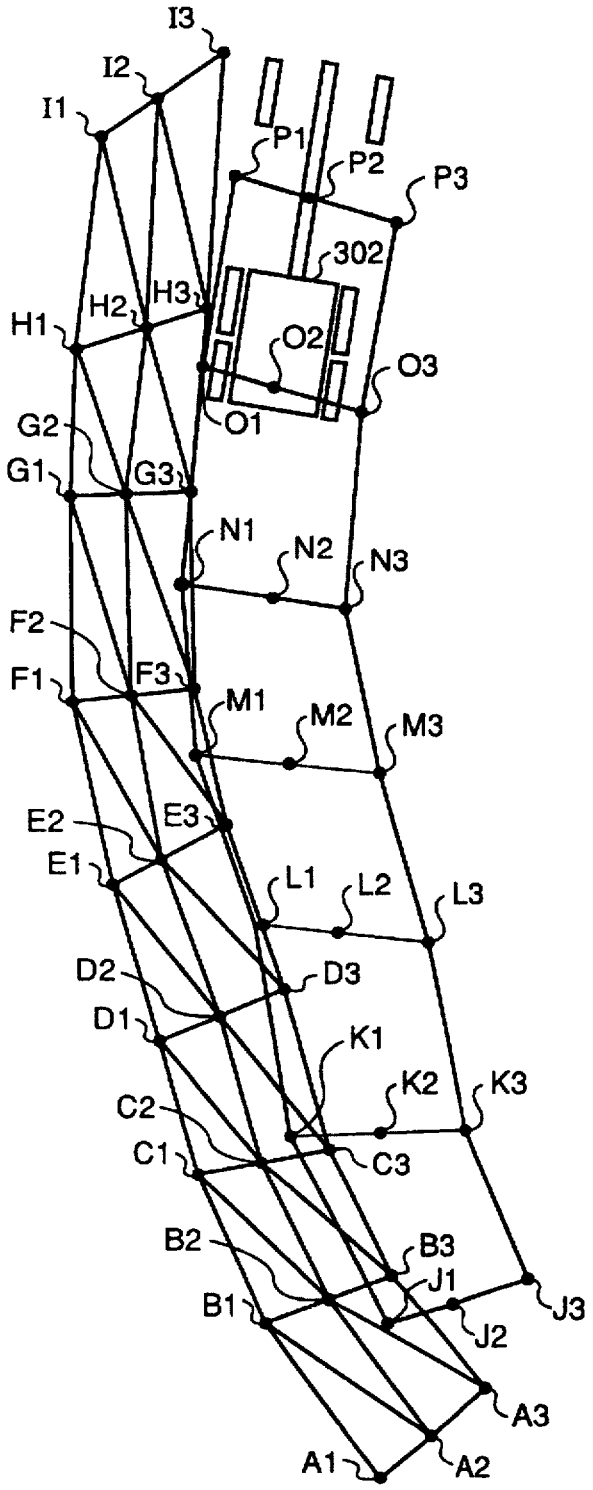
FIG. 6 is a diagrammatic top view of the motor grader of FIG. 3 illustrating a portion of a Triangular Irregular Network and new datapoints to be included in the network.

With reference to FIG. 6, a portion of a sample Triangular Irregular Network is illustrated. The sample portion is defined by points A1–A3, B1–B3, C1–C3, D1–D3, E1–E3, F1–F3, G1–G3, H1–H3, and I1–I3. As the mobile machine 302 traverses the work site 202, new data points (J1–J3, K1–K3, L1–L3, M1–M3, N1–N3, O1–O3, and P1–P3) are determined. These datapoints are then integrated into the TIN.

In one embodiment, the TIN represents the current site surface (CSS). The CSS represents the current surface of the work site. Thus, as the mobile machine 302 traverses the work site 202 and new datapoints are generated, the new datapoints are incorporated into the TIN. Those datapoints previously existing in the TIN which are covered by the new datapoints are erased from the TIN. For example in FIG. 3, points J1–J3, K1–K3, L1–L3, M1–M3, N1–N3, O1–O3, and P1–P3, represent new datapoints. The area covered by these new datapoints covers existing points B3, C3, D3, E3, and F3. Therefore points B3, C3, D3, E3, and F3 are deleted from the TIN.

Figure 7:
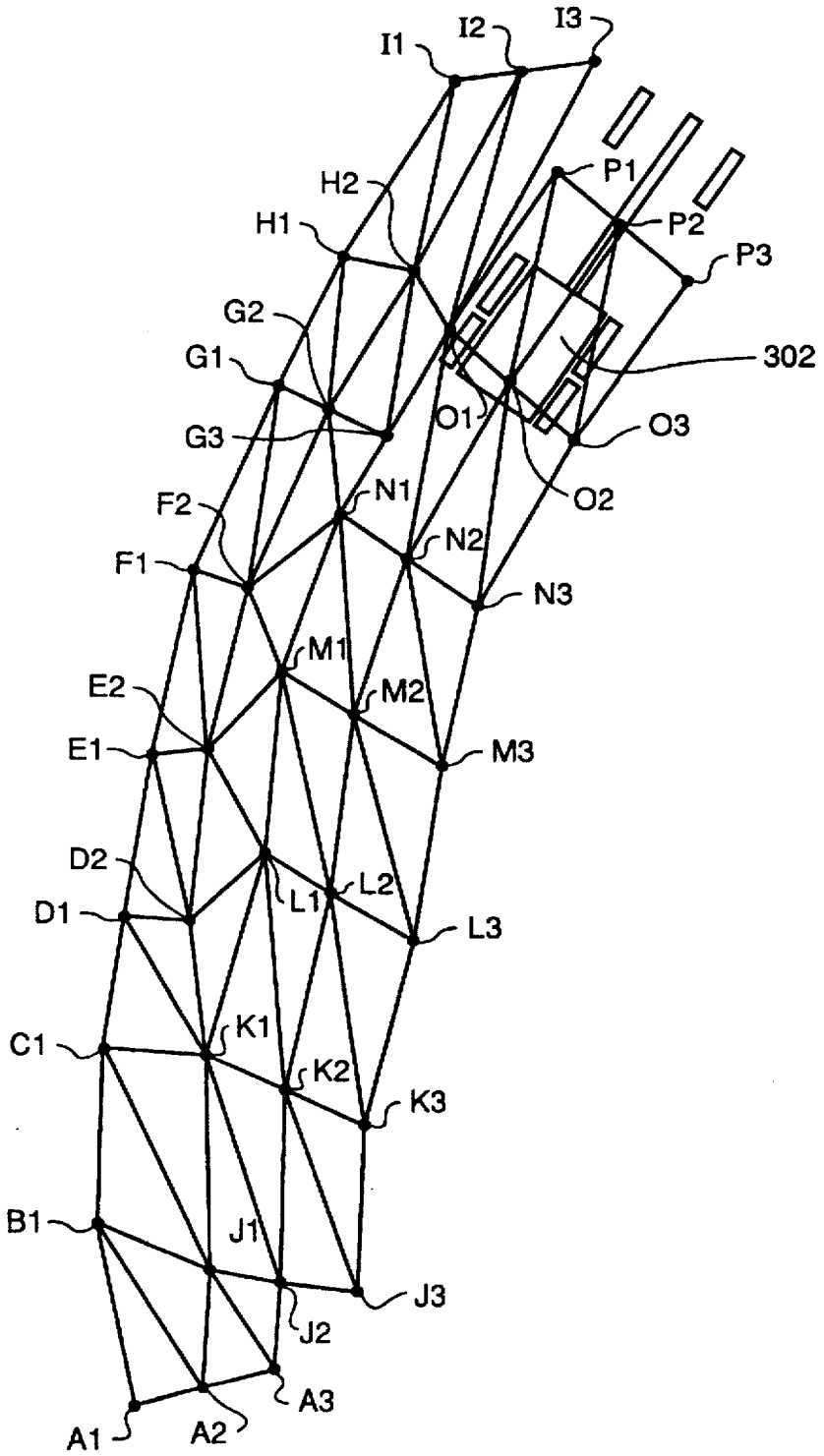
FIG. 7 is a diagrammatic top view of the motor grader of FIG. 6 illustrating a portion of a Triangular Irregular Network and new datapoints incorporated into the network according to an embodiment of the present invention.

With reference to FIG. 7, the new datapoints are incorporated into the TIN by connecting them to adjacent new and existing datapoints to form triangles. The three new datapoints represented by a single letter, e.g., L1, L2, and L3, represent the left blade tip point, the blade midpoint, and the right blade tip point, respectively.

First, new datapoints are interconnected. In the preferred embodiment, this is done in the following manner. The left blade tip point, the blade midpoint, and the right blade tip point, e.g., L1, L2, and L3, at a particular machine position are connected. The left blade tip point, e.g., L1, is also connected to a previous left blade tip point (K1), a previous midpoint (K2), and a subsequent left blade tip point (M1). The right blade tip point, e.g., L3, is also connected to a previous right blade tip point (K3), a subsequent midpoint (M2), and a subsequent right blade tip point (M3).

Second, the new datapoints must be connected to datapoints already existing in the TIN. In the preferred embodiment, for each replaced point, the closest new datapoint replaces the broken connections. For example, for replaced point D3, the closest new datapoint is left blade tip point, L3. L3 is therefore also connected to all still existing points which D3 was connected to, i.e., D2 and E2.

In another embodiment, the TIN represents an original ground layer (OGL). The original ground layer represents the first pass of the mobile machine 302 over the work site 202. Thus, as the mobile machine 302 traverses the work site 202 and new datapoints are generated, only those new datapoints which represent the first pass over that portion of the work site are incorporated into the TIN. For example, in FIG. 6, points J1–J3, K1–K3, L1–L3, M1–M3, N1–N3, O1–O3, and P1–P3 represent new datapoints. However, points J1, K1, L1, M1, and N1 are contained within the existing TIN portion. Therefore these points are not incorporated into the TIN.

Figure 8:
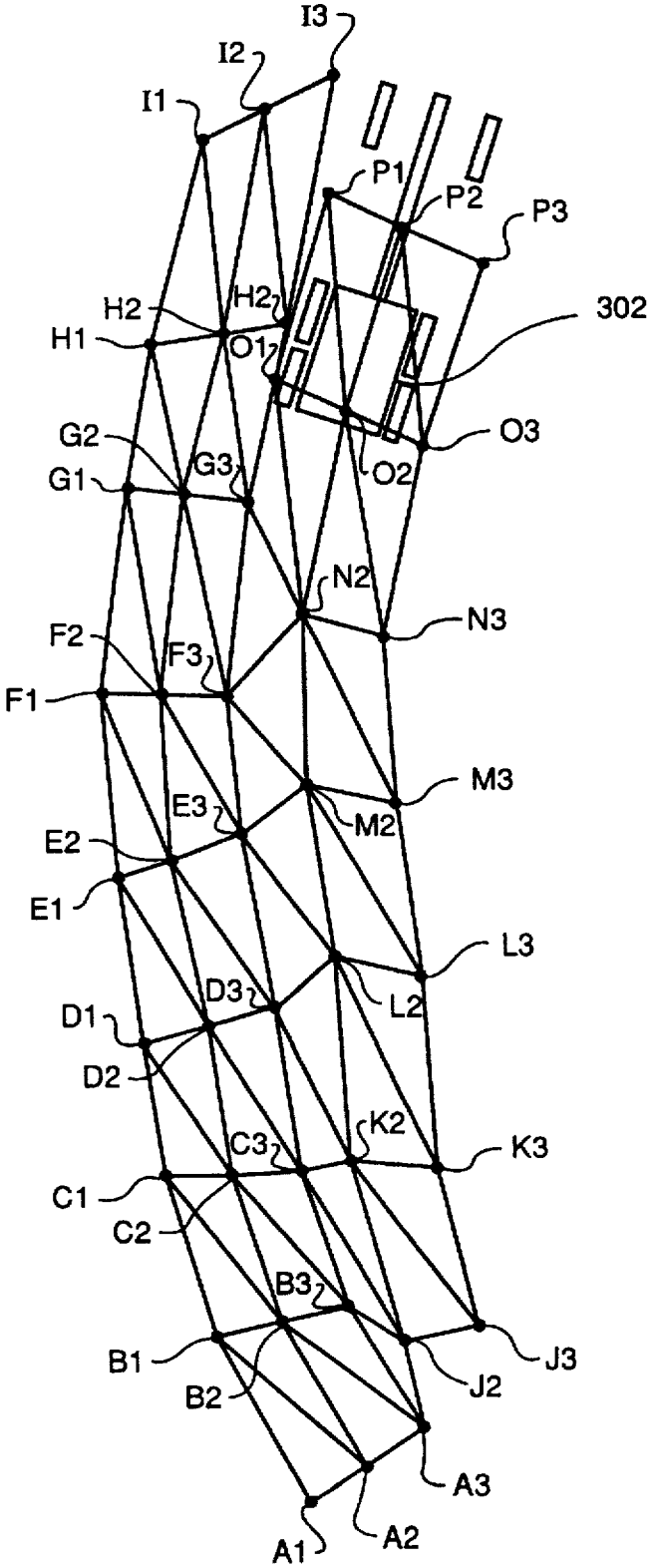
FIG. 8 is a diagrammatic top view of the motor grader of FIG. 6 illustrating a portion of a Triangular Irregular Network and new datapoints incorporated into the network according to another embodiment of the present invention; and, FIG. 9 is a flow diagram illustrating operation of a method for updating a site database, according to an embodiment of the present invention.

Referring to FIG. 8, the updated TIN representing the OGL is shown. Note that Points J1, K1, L1, M1, and N1 are not included. The remaining new points and the existing points form the triangles which define the TIN.

The new datapoints are incorporated into the TIN by connecting them to other new datapoints and existing datapoints to form triangles. The three new datapoints represented by a single letter, e.g., L1, L2, and L3, represent the left blade tip point, the blade midpoint, and the right blade tip point, respectively.

First, the new datapoints which are to be incorporated are interconnected. In the preferred embodiment, this is done in a manner similar to that described above.

Second, the new datapoints must be connected to datapoints already existing in the TIN. In the preferred embodiment, for each new point which is not to be incorporated, e.g., L1, it is replaced by the closest existing point. For example, if L1 were to be incorporated into the TIN, it would be connected to points K2 and L2. The closest existing point to L1 is D3. Therefore D3 is also connected to points K2 and L2.

Figure 9:
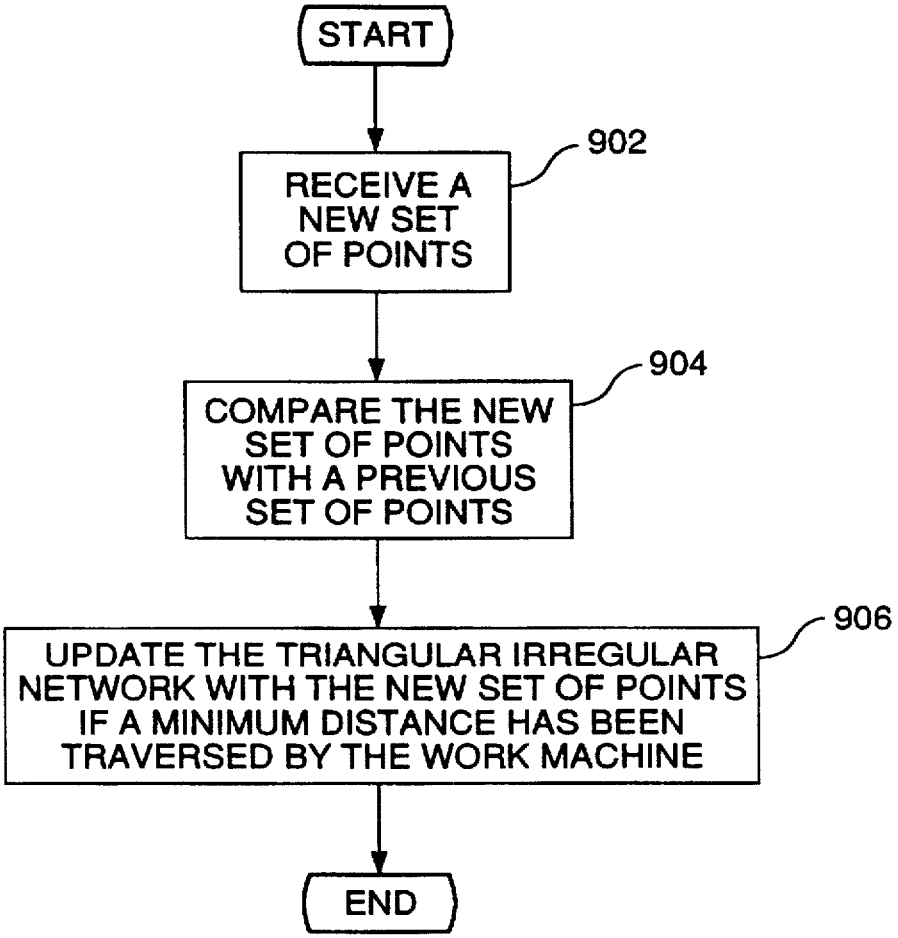

With reference to FIG. 9, the method of updating the site database 204 will now be explained. In a first step 902, a new set of points is received from the position sensing system 102. In one embodiment, the set of points includes at least first and second points. In the preferred embodiment, the set of points includes three points corresponding to the left and right blade tip points and the midpoint of a motorgrader blade.

In a second step 904, the new set of points is compared with a previous set of points. In the preferred embodiment, there must be a predetermined distance between sets of datapoints in order for the new data points to be stored and incorporated into the TIN.

In a third step 906, the TIN is updated with the new datapoints if the minimum distance requirement is met.

INDUSTRIAL APPLICABILITY

With reference to the drawings and in operation, the present invention provides an apparatus, a memory, and a method for storing and updating data for access by an application program being executed on the controller 116 on the work machine 302. The data represents the elevation of the work site 202.

As the work machine 302 traverses the work site 202, datapoints representing coordinate positions on the work site 202 are determined and updated to provide a database containing information indicating the original and current configurations of the work site 202.

Other aspects, objects, and features of the present invention can be obtained from a study of the drawings, the disclosure, and the appended claims.

We claim:

1. A method for updating a site database, the site database modeling an elevation of a work site using a Triangular Irregular Network (TIN), the TIN being composed of a plurality of points, each point having associated known X and Y coordinates and a known elevation and being associated with a set of other points in the TIN to form triangles, including the steps of:

receiving a new set of points, the new set of points including at least first and second points, the first and second points having associated X, Y, and Z coordinates;

comparing said new set of points with a previous set of points; and updating the Triangular Irregular Network with the new set of points if a minimum distance has been traversed by a work machine.

2. A method, as set forth in claim 1, wherein a work machine modifies the work site and the site database is updated in real time.

3. A method, as set forth in claim 2, wherein the work machine is a motor grader, the motor grader having a work implement with a blade.

4. A method, as set forth in claim 3, wherein the new set of points includes first, second, and third points, the first, second, and third points corresponding to a left blade tip point, a mid blade point, and a right blade tip point, respectively, and including the step of determining the positions of the first, second, and third points.

5. A method, as set forth in claim 1, wherein the site database represents an original ground layer and wherein only the points in the new set of points which are not covered by an existing TIN are incorporated into the TIN.

6. A method, as set forth in claim 1, wherein the site database represents a current site surface and wherein all points in the new set of points are incorporated into the TIN.

* * * * *

UNITED STATES PATENT AND TRADEMARK OFFICE

CERTIFICATE OF CORRECTION

PATENT NO. : 5,735,352
DATED : 04/07/1998
INVENTOR(S) : Daniel E. Henderson
Craig L. Koehrsen
David A. Paul, William C. Sahm It is certified that error appears in the above-identified patent and that said Letters Patent is hereby corrected as shown below:

On page 1 at line 4, in a separate paragraph after the title , "METHOD FOR UPDATING A SITE DATABASE USING A TRIANGULAR IRREGULAR NETWORK", forming a new paragraph insert –The invention described herein was made in the performance of work under NASA Contract No. TRP SOL93-29 and is subject to the provisions of Section 305 of the National Aeronautics and Space Act of 1998 (42 U.S.C. 2457).

Signed and Sealed this

Tenth Day of October, 2000

*Attest:*

Q. TODD DICKINSON

*Attesting Officer*

*Director of Patents and Trademarks*